US009251807B2

(12) United States Patent
Jung et al.

(10) Patent No.: US 9,251,807 B2
(45) **Date of Patent: *Feb. 2, 2016**

(54) ACOUSTIC COMMUNICATION DEVICE AND METHOD FOR FILTERING AN AUDIO SIGNAL TO ATTENUATE A HIGH FREQUENCY SECTION OF THE AUDIO SIGNAL AND GENERATING A RESIDUAL SIGNAL AND PSYCHOACOUSTIC SPECTRUM MASK

(71) Applicant: Samsung Electronics Co., Ltd., Gyeonggi-do (KR)

(72) Inventors: Hee-Won Jung, Gyeonggi-do (KR); Jun-Ho Koh, Gyeonggi-do (KR); Sang-Mook Lee, Gyeonggi-do (KR); Gi-Sang Lee, Gyeonggi-do (KR); Sergey Zhidkov, Izhevsk (RU)

(73) Assignee: Samsung Electronics Co., Ltd. (KR)

( * ) Notice: Subject to any disclaimer, the term of this patent is extended or adjusted under 35 U.S.C. 154(b) by 226 days.

This patent is subject to a terminal disclaimer.

(21) Appl. No.: 14/011,466

(22) Filed: Aug. 27, 2013

(65) Prior Publication Data

US 2013/0346070 A1 Dec. 26, 2013

Related U.S. Application Data

(63) Continuation of application No. 12/965,295, filed on Dec. 10, 2010, now Pat. No. 8,521,518.

(60) Provisional application No. 61/285,372, filed on Dec. 10, 2009.

(30) Foreign Application Priority Data

Nov. 25, 2011 (KR) ..... 10-2010-0118134

(51) Int. Cl.
*G10L 21/0232* (2013.01)
*G10L 19/02* (2013.01)

(52) U.S. Cl.
CPC ..... *G10L 21/0232* (2013.01); *G10L 19/02* (2013.01)

(58) Field of Classification Search
CPC ..... G10L 19/02; G10L 21/0232
USPC ..... 704/200.1
See application file for complete search history.

(56) References Cited

U.S. PATENT DOCUMENTS 6,526,385 B1 2/2003 Kobayashi et al.
8,242,836 B2 8/2012 Sato et al.

(Continued)

FOREIGN PATENT DOCUMENTS

JP 2000-172282 6/2000
JP 2001-127643 5/2001

(Continued)

OTHER PUBLICATIONS

Daniel Gruhl et al., "Echo Hiding", May 30, 1996.

(Continued)

*Primary Examiner* — Susan McFadden
(74) *Attorney, Agent, or Firm* — The Farrell Law Firm, P.C.

(57) ABSTRACT

An acoustic communication method and device are provided that filter an audio signal to attenuate a high frequency section of the audio signal; generate a residual signal which corresponds to a difference between the audio signal and the filtered signal; generate a psychoacoustic mask for the audio signal based on a predetermined psychoacoustic model; generate a psychoacoustic spectrum mask by combining the residual signal with the psychoacoustic mask; generate an acoustic communication signal by modulating digital data according to the acoustic signal spectrum mask; and combine the acoustic communication signal with the filtered signal.

18 Claims, 7 Drawing Sheets

(56) References Cited

U.S. PATENT DOCUMENTS

| | | | | |
|---|---|---|---|---|
| 8,521,518 | B2 * | 8/2013 | Jung et al. | 704/200.1 |
| 8,612,215 | B2 * | 12/2013 | Son et al. | 704/205 |
| 8,972,246 | B2 * | 3/2015 | Park et al. | 704/200.1 |
| 2001/0044727 | A1 | 11/2001 | Nakatoh et al. | |
| 2004/0088160 | A1 | 5/2004 | Manu | |
| 2005/0043830 | A1 | 2/2005 | Lee et al. | |
| 2011/0176683 | A1 | 7/2011 | Iwaki et al. | |

FOREIGN PATENT DOCUMENTS

| | | |
|---|---|---|
| JP | 2001-148670 | 5/2001 |
| JP | 2002-304184 | 10/2002 |
| JP | 2003-280697 | 10/2003 |
| JP | 2010-044117 | 2/2010 |
| KR | 1020050054745 | 6/2005 |

OTHER PUBLICATIONS

Laurence Boney et al., "Digital Watermarks for Audio Signals", Mar. 1996.

Yusuke Nakashima et al., "Evaluation and Demonstration of Acoustic OFDM", 2006.

ISO 11172-3: 1993, Annexes C & D, 3-Annex C (Informative), The Encoding Process.

* cited by examiner

ACOUSTIC COMMUNICATION DEVICE AND METHOD FOR FILTERING AN AUDIO SIGNAL TO ATTENUATE A HIGH FREQUENCY SECTION OF THE AUDIO SIGNAL AND GENERATING A RESIDUAL SIGNAL AND PSYCHOACOUSTIC SPECTRUM MASK

PRIORITY

This application is a Continuation Application of U.S. application Ser. No. 12/965,295 which was filed in the U.S. Patent and Trademark Office on Dec. 10, 2010 and claims priority under 35 U.S.C. §119(a) to a U.S. Provisional Application entitled "Device And Method For Acoustic Communication" filed in the United States Patent and Trademark Office on Dec. 10, 2009, assigned Ser. No. 61/285,372 and to a Korean Patent Application filed in the Korean Intellectual Property Office on Nov. 25, 2010, assigned Serial No. 10-2010-0118134, the contents of each of which are incorporated herein by reference.

BACKGROUND OF THE INVENTION

1. Field of the Invention

The present invention relates generally to a method and a device for acoustic communication in which digital data is transmitted among mobile devices using acoustic signals, and in particular, to a method and a device for acoustic communication using a psychoacoustic model.

2. Description of the Related Art

Acoustic communication is one of the possible ways to transfer digital information between mobile devices. An advantage of acoustic communication is that the data communication protocols can be implemented on existing devices using only software without having to add any hardware elements such as antenna and RF front-end, as required for radio-based communication systems.

Several methods have been proposed to mask acoustic communication by music or speech signals to make the acoustic communication sound pleasant to the human ear and to convey additional human-understandable information. Such methods include "echo-hiding" or adding spread-spectrum signal below noise level, as discussed in D. Gruhl, et al., *Echo Hiding*, Proceedings of the First International Workshop on Information Hiding, Cambridge, U.K., May 30-Jun. 1, 1996, pp. 293-315, and L. Boney, et al., *Digital watermarks for audio signals*, IEEE Intl. Conf. on Multimedia Computing and Systems, pp. 473-480, March 1996, respectively.

FIG. 1 illustrates a conventional method for mixing an audio program with an acoustic communication signal. A device 100 for implementing such method includes an acoustic communication signal generator 110, a combiner 120 and a speaker 130. In the above method, a low level communication signal such as a spread spectrum signal is simply added to the audio program such as music, speech, alarm sound or the like. The audio program and the acoustic communication signal output from the acoustic communication signal generator 110 are combined (or mixed) by the combiner 120. The combined signal is radiated in a form of sound waves through the speaker 130.

Unfortunately, conventional methods fail to fully exploit the capacity of an acoustic communication channel, and therefore achieve only very low bit rates, i.e. several bits per second.

A better method, such as the type described by Y. Nakashima, et al., in *Evaluation and Demonstration of Acoustic OFDM*, Proc. Fortieth Asilomar Conference on Signals, Systems and Computers, 2006. ACSSC 2006, pp. 1747-1751, is based on replacement of high frequency components of speech/music audio program with spectrally shaped communication signal.

FIG. 2 is illustrates a method for generating an audio signal mixed with an acoustic communication signal using the known frequency replacement technology. A device 200 for implementing such method includes a Fast Fourier Transform (FFT) block 210, a band splitter 220, an Inverse Fast Fourier Transform (IFFT) block 230, a Forward Error Correction (FEC) coding block 240, an Orthogonal Frequency Division Multiplexing (OFDM) modulator 250, a combiner 260 and a speaker 270.

The FFT block 210 performs FFT on the original audio signal (or program) such as music or speech. Hereinafter, the band splitter 220 divides the FFT audio signal into high frequency bins and low frequency bins, outputs the low frequency bins to the IFFT block 230, and outputs the high frequency bins to the OFDM modulator 250. The IFFT block 230 performs the IFFT on the original audio signal, from which the high frequency bins are removed.

The FEC coding block 240 performs FEC coding on the input digital data and outputs the data. The OFDM modulator 250 performs OFDM on the coded digital data according to the high frequency bins and outputs the data, and the acoustic communication signal from the OFDM modulator has a spectral envelope which is shaped similar to the high frequency bins. In other words, the high frequency bins are replaced with the acoustic communication signal.

FIGS. 3A and 3B illustrate signals which are generated according to the frequency replacement technologies. FIG. 3A shows the frequency spectrum of an original audio signal 330, and FIG. 3B shows the frequency spectrum of a modified audio signal 330*a* which has a replacement acoustic communication signal. In each frequency spectrum, the frequency is shown along the horizontal axis, and the signal strength is shown along the vertical axis. As shown in FIG. 3A, the original audio signal 330 is divided into the high frequency bins (or region) 320 and the low frequency bins 310 based on frequency division. As shown in FIG. 3B, the low frequency bins 310 of the modified audio signal 330*a* are the same as those of the original audio signal, and the high frequency bins 320 of the original audio signal are replaced with the acoustic communication signal 325 of the modified audio signal.

This method allows for simple implementation of an acoustic signal receiver since the original audio signal and the acoustic communication signal are transmitted in separate frequency bands. This method, however, has two drawbacks.

Firstly, the method degrades the quality of the original audio signal, i.e. the music/speech signal, because there is a sharp transition in frequency domain between the original audio signal and the acoustic communication signal, see FIG. 3B.

Secondly, this method fails to fully utilize available signal bandwidth, since the acoustic communication signal only concentrates in relatively high audio frequencies. Consequently, if the music/speech audio program does not contain high frequency bins, or if the receiving device microphone is not capable of capturing the entire wideband audio spectrum, including high frequency bins, the acoustic data communication shall be impossible (even with reduced bit rate).

SUMMARY OF THE INVENTION

Accordingly, the present invention has been made to solve the above-mentioned problems occurring in the prior art, and an aspect of the present invention provides a device and a method for acoustic communication in which a steep boundary between the original audio signal and the replacement acoustic communication signal can be avoided.

Another aspect of the present invention provides a device and a method for acoustic communication making use of the entire spectrum of the original audio signal.

In accordance with an aspect of the present invention, there is provided an acoustic communication method that includes filtering an audio signal to attenuate a high frequency section of the audio signal; generating a residual signal which corresponds to a difference between the audio signal and the filtered signal; generating a psychoacoustic mask for the audio signal based on a predetermined psychoacoustic model; generating a psychoacoustic spectrum mask by combining the residual signal with the psychoacoustic mask; generating an acoustic communication signal by modulating digital data according to the acoustic signal spectrum mask; and combining the acoustic communication signal with the filtered signal.

The method and the device for acoustic communication according to the invention provide at least the following advantages.

Firstly, according to the present invention, the audio sensitivity of distorted signals caused by inserting the acoustic communication signal into the audio program can be reduced.

Secondly, according to the present invention, the entire bandwidth is effectively used to allow data transmission even if a receiving microphone does not detect the entire wideband audio spectrum, or if the audio program does not include high frequency bins.

BRIEF DESCRIPTION OF THE DRAWINGS

The above and other aspects, features and advantages of the present invention will be more apparent from the following detailed description taken in conjunction with the accompanying drawings, in which.

DETAILED DESCRIPTION OF PREFERRED EMBODIMENTS

Figure 1:
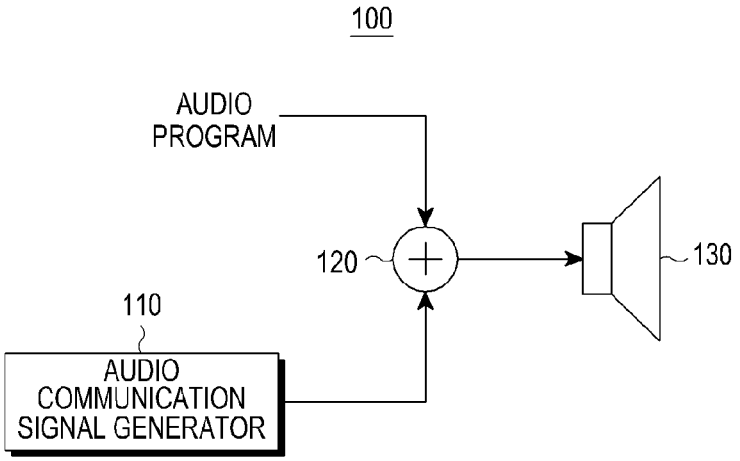
FIG.1 (PRIOR ART)
FIG. 1 illustrates a conventional method for mixing an audio program with an acoustic communication signal.
Figure 2:
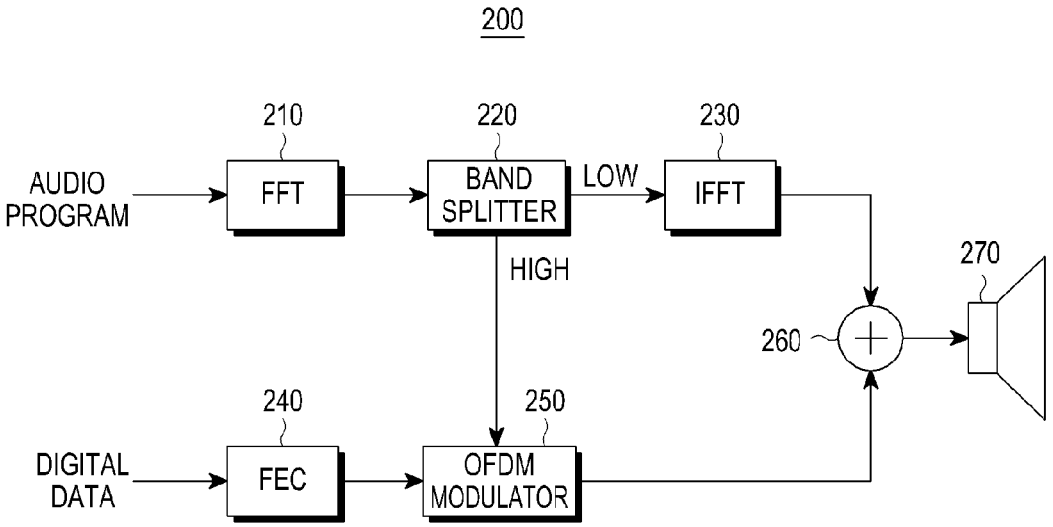
FIG. 2 illustrates an audio signal mixed with an acoustic communication signal using the known frequency replacement technology.
Figure 3A:
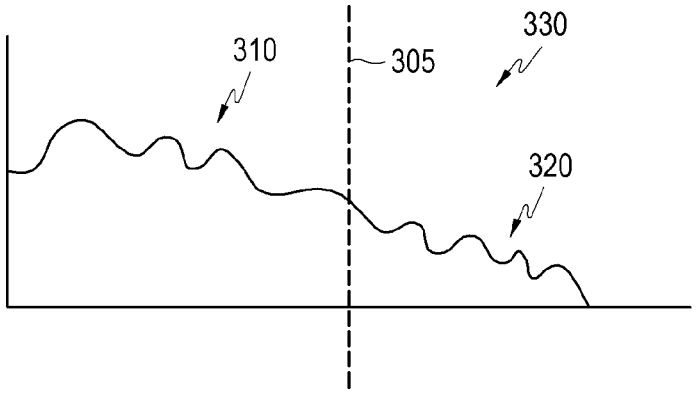
FIGS. 3A and 3B illustrate signals which are generated according to the frequency replacement technologies.
Figure 3B:
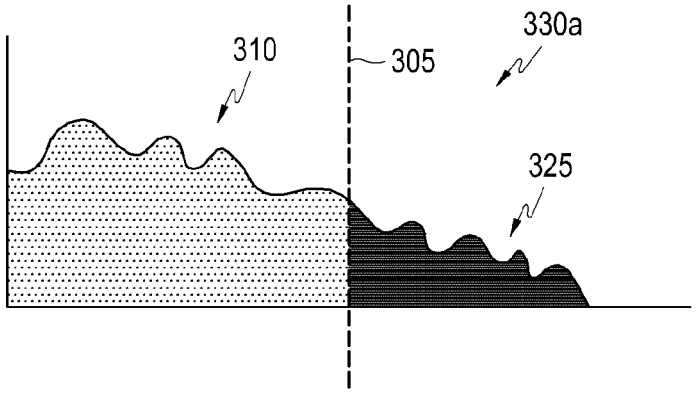

It is apparent to those skilled in the art that the elements in the drawings are illustrated as an example for simplicity and clearness and are not illustrated based on the scales thereof. For example, the dimension of some elements in the drawings may be exaggerated compared with other elements in order to help with understanding.

Further, the steps of the method and the elements of the device are represented by general symbols in the drawings, and it should be noted that only the details of the invention are illustrated. The details known to those skilled in the art may be omitted. In the specification, the relative terms such as "the first" and "the second" may be used to divide one element from another element, and do not mean any actual relationship or an order between these elements.

In an embodiment of the present invention, two basic ideas are set forth. First, a steep boundary between the original audio signal and the replacement acoustic communication signal is avoided. Second, a small amount of acoustic communication signal is added in the entire available audio signal spectrum to the extent that such addition is not perceivable by the human ear.

To generate the acoustic communication signal according to the present invention, the original audio signal, such as music or speech, is filtered in a high-shelf filter, which gradually attenuates the high frequency bins. See for example, FIG. 5B as described herein. Thereafter, the difference between the original signal and the attenuated signal is calculated. The spectral shape of such residual signal is stored. Further, so-called psychoacoustic (or frequency) masking threshold is calculated according to spectral shape of the original audio signal. The calculation of the psychoacoustic masking threshold is based on the fact that in the presence of strong audio signals on some frequencies sound signals on nearby frequency may become inaudible for an average listener. This effect is illustrated and explained with reference to FIG. 6.

This effect is known as a frequency masking effect and is widely used in the lossy audio compression algorithms in which the signal frequency bins below the audibility threshold are removed. In the present invention, the frequency masking threshold is calculated in order to place the acoustic communication signal below the masking threshold, thus making it inaudible.

Finally, two spectrum shapes, i.e. residual spectrum and psychoacoustic masking spectrum derived from the frequency masking threshold, are combined to produce the final spectral envelope mask for the acoustic communication signal.

Figure 4:
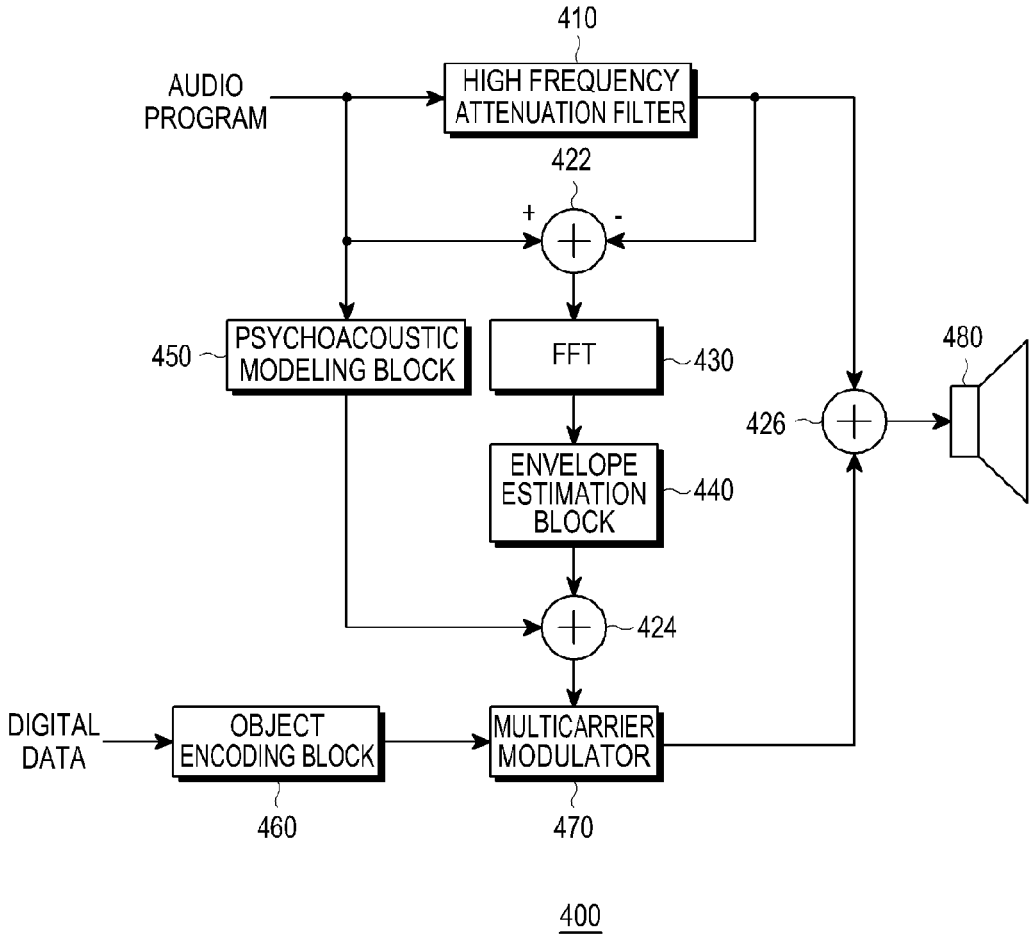
FIG. 4 illustrates a device for performing an acoustic communication according to an embodiment of the present invention.

FIG. 4 is a diagram illustrating a device for performing acoustic communication according to an embodiment of the present invention. FIGS. 5A to 5F are diagrams illustrating signal spectrums in different steps of the signal generating procedure according to the present invention.

As shown in FIG. 4, a device 400 is provided that includes a high frequency attenuation filter 410, a first combiner 422, an FFT block 430, an envelope estimation block 440, a psychoacoustic modeling block 450, a second combiner 424, an object encoding block 460, a multicarrier modulator 470, a third combiner 426 and a speaker 480.

Figure 5A:
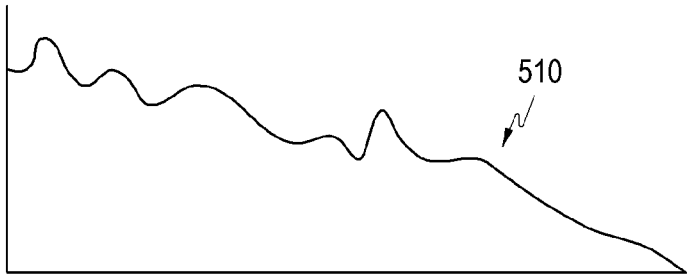
FIGS. 5A to 5F illustrate signal spectrums in different steps of the signal generating procedure according to an embodiment of the present invention.

FIG. 5A shows a frequency spectrum of the original audio signal 510. In FIGS. 5A and 5C to 5F, the frequency is shown along the horizontal axis, and the signal strength is shown along the vertical axis. Even though only the outlines, i.e. envelopes, of the frequency spectrums are illustrated, these envelopes include a number of frequency bins.

Figure 5B:
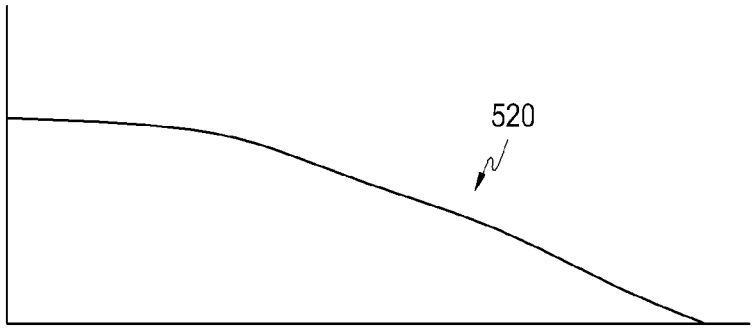

The high frequency attenuation filter 410 has filter response characteristics, so that the filter gradually reduces spectral energy in the medium and high frequency region. FIG. 5B shows the filter response characteristics 520 of the high frequency attenuation filter 410, in which the frequency is shown along the horizontal axis and the signal transmittance is shown along the vertical axis. Referring to FIG. 5B, it can be seen that the high frequency attenuation filter 410 passes most signals in the low frequency region without any change and reduces the signals gradually in the medium and high frequency region.

The original audio signal is filtered by the high frequency attenuation (or high-shelf) filter 410. As shown in FIG. 5B there is no steep cut-off frequency (for example, see FIG. 5*b* for reference) in the filter response characteristics. Therefore, the spectral distortions introduced by the high frequency attenuation filter 410 are less annoying to the human ear.

Figure 5C:
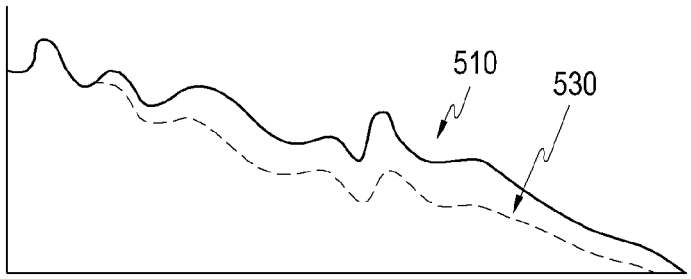

FIG. 5C shows the frequency spectrums of the original audio signal 510 and the filtered signal 530.

The original audio signal and the filtered signal are input to the first combiner 422, which outputs a difference, i.e. residual signal, between the original signal and the filtered signal.

Figure 5D:
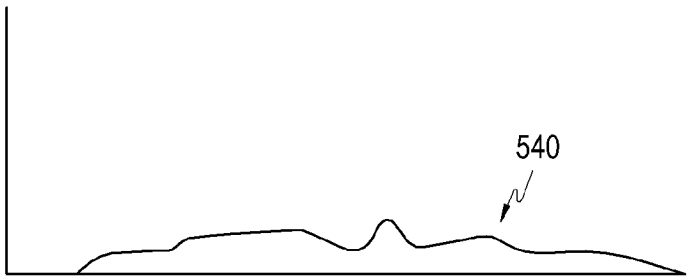

FIG. 5D shows the frequency spectrum of the residual signal 540 which is output from the first combiner 422. The residual signal 540 corresponds to the difference between the original signal 510 and the filtered signal 530.

The FFT block 430 performs the FFT on the residual signal. In other words, the FFT block 430 converts the residual signal in the time domain into the signal in the frequency domain.

The envelope estimation block 440 analyzes the converted residual signal and estimates (or detects) the envelope which is the spectral shape of the residual signal.

Since the residual signal is removed from the original audio signal (or program), it must be compensated by an acoustic communication signal with an identical spectrum shape. However, as described above, it is also possible to add the additional acoustic communication signal without compromising audio quality if its spectral mask does not exceed the frequency masking threshold (threshold of audibility). In an embodiment of the present invention, to avoid generation of the acoustic communication signal twice, two spectral masks are simply combined together.

The psychoacoustic modeling block 450 calculates a psychoacoustic mask from the original audio according to the common psychoacoustic model which is, for example, defined in ISO-IEC 11172, part 3, Annex D.

Figure 6:
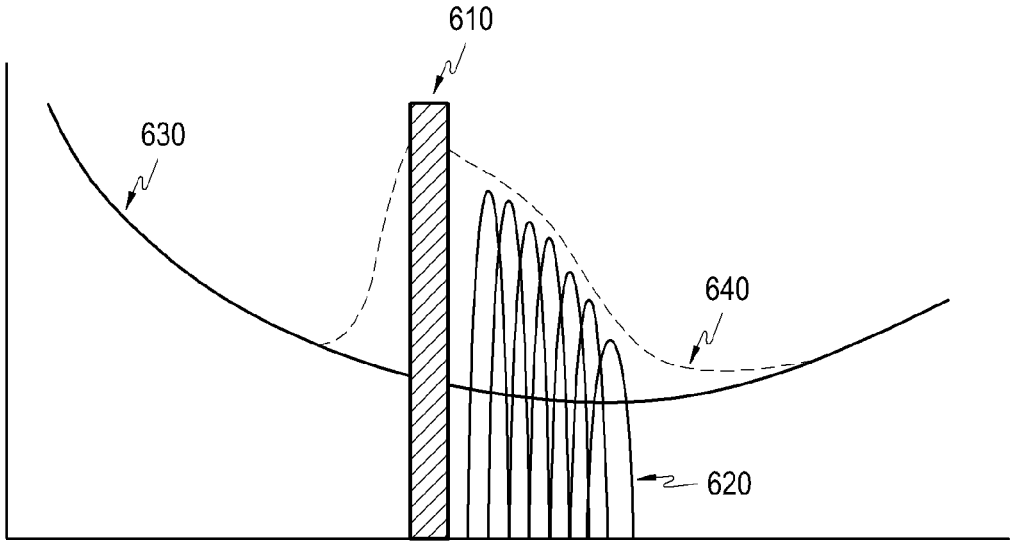
FIG. 6 illustrates a method for calculating a frequency masking threshold and for placing the acoustic communication signal below the threshold.

FIG. 6 illustrates a method for calculating a frequency masking threshold and for placing the acoustic communication signal below the threshold. For convenience of understanding, FIG. 6 illustrates the frequency masking threshold (i.e. an actual audibility threshold) 640 for the original audio signal with one masker 610.

An absolute audibility threshold 630 shows the threshold strength distribution of each frequency that the human ear has difficulty hearing in a quiet atmosphere. The one masker 610 is the frequency bin having a maximum signal strength compared with nearby frequency bins (maskees) 620 in the original audio signal. Without the masker 610, the maskees 620 exceeding the absolute audibility threshold 630 can be heard. In this example, the maskees (that is, small sounds) 620 are veiled by the masker (that is, large sound) 610, so that the maskees 620 are not heard. This effect is referred to as a masking effect. Reflecting such a masking effect, the actual audibility threshold for the masks 620 rises (or increases) over the absolute audibility threshold 630, with the rising audibility threshold referred to as the frequency masking threshold 640. In other words, the frequency bins below the frequency masking threshold 640 cannot be heard.

Referring back to FIG. 4, the psychoacoustic mask calculated by the psychoacoustic modeling block 450 corresponds to the difference between the frequency masking threshold and the original audio signal.

Figure 5E:
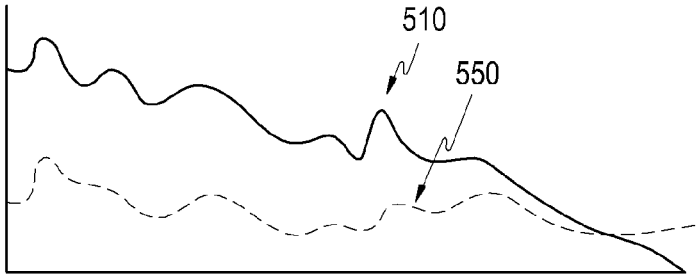

FIG. 5E shows the psychoacoustic mask 550 which is output from the psychoacoustic modeling block 450. In FIG. 5E, the original audio signal 510 is also illustrated, for comparison.

The second combiner 424 combines the first mask, i.e. the residual spectrum, input from the envelope estimation block 440 with the second mask, i.e. the psychoacoustic mask for the original audio signal, input from the psychoacoustic modeling block 450 and generates the final acoustic signal spectrum mask, and then outputs the generated acoustic signal spectrum mask to the multicarrier modulator 470. The final acoustic signal spectrum mask is used for generating the acoustic communication spectrum.

Figure 5F:
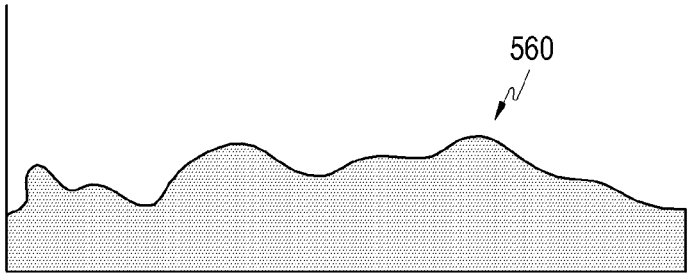

FIG. 5F shows an acoustic signal spectrum mask 560 output from the second combiner 424. The acoustic signal spectrum mask 560 corresponds to the sum of the psychoacoustic mask 550 and the residual signal 540, as shown in FIGS. 5E and 5D, respectively.

The object encoding block 460 encodes the input digital data into symbols or objects, and outputs them. For example, the object encoding block 460 can perform Quadrature Amplitude Modulation (QAM).

The multicarrier modulator 470 performs multicarrier modulation on the encoded digital data, i.e. symbols, according to the acoustic signal spectrum mask input from the second combiner 424, and outputs the resultant signal. For example, the multicarrier modulator 470 can perform the OFDM in which the symbols input from the object encoding block 460 is multiplexed by the frequency bins in the acoustic signal spectrum mask input from the second combiner 424, and then the resultant values are combined and output. The acoustic communication signal output from the multicarrier modulator 470 includes a frequency spectrum similar to that included in the acoustic signal spectrum.

The third combiner 426 combines the filtered signal input from the high frequency attenuation filter 410 with the acoustic communication signal output from the multicarrier modulator 470. The speaker 480 radiates the combined signal in a form of sound waves.

In an example of the present invention, it is preferable that the multicarrier communication signal is used as the acoustic communication signal, in view of the ease to form an arbitrary spectral shape for the multicarrier signal. However, it is not necessary and other types of communication signals, for example, Code-Division Multiple Access (CDMA) or spread-spectrum signals can also be used.

The psychoacoustic mask calculation method is preferably used in the lossy audio compression codec, for example, it can be based on the psychoacoustic model from MPEG layer II standard which is defined in ISO-IEC 11172, part 3, Annex D. It should be noted that calculation of the psychoacoustic masking threshold is more complicated than just calculation of the masking effect from a single masker.

As described above, since the psychoacoustic mask used in the invention is calculated according to the common psychoacoustic models, with a simplified description provided below.

Figure 7:
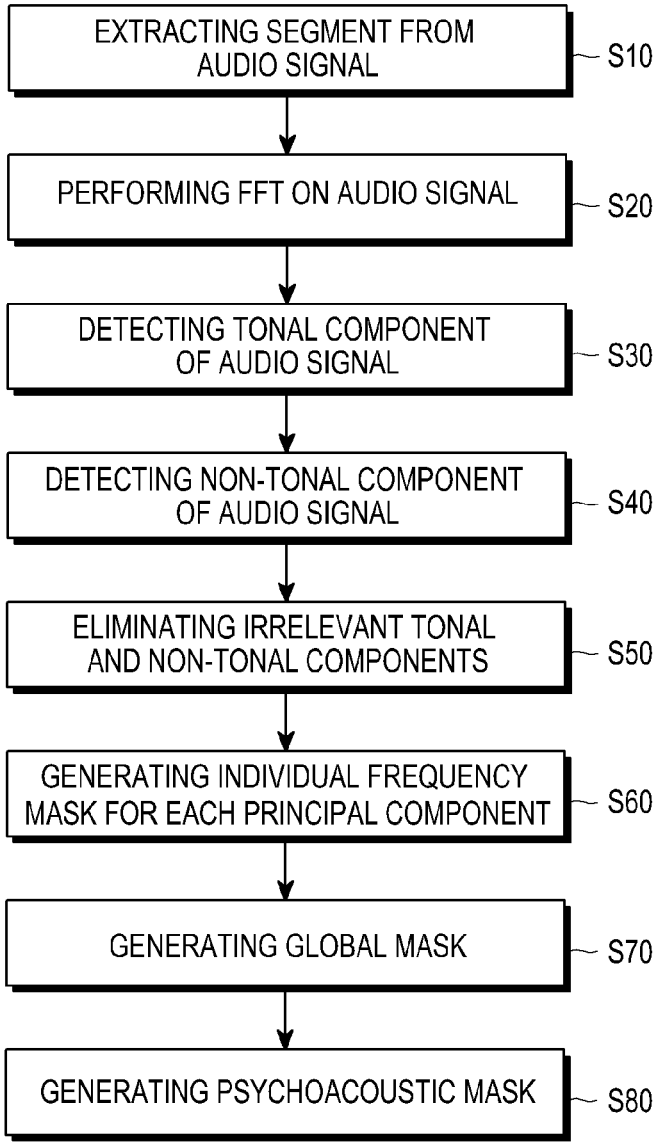
FIG. 7 is a flowchart illustrating main steps of a method for calculating a psychoacoustic mask according to an embodiment of the present invention.

FIG. 7 is a flowchart illustrating main steps of a method for calculating the psychoacoustic mask according to the present invention, which includes a segment extraction step S10, an FFT step S20, a tonal component detection step S30, a non-tonal component detection step S40, an irrelevant tonal and non-tonal component elimination step S50, an individual frequency mask generation step S60, a global mask generation step S70 and a psychoacoustic mask generation step S80.

In the segment extraction step S10, a temporally short segment is extracted from the original audio signal, with this step repeated in each segment unit.

In the FFT step S20, the original audio signal is subjected to the FFT. In other words, the original audio signal is converted into a signal from the time domain to the frequency domain.

In the tonal component detection step S30, maximum frequency components which have a strength larger than that of the nearby frequency components are detected from the frequency components of the original audio signal. In the maximum frequency components, when the difference in strength between the nearby frequency component and the maximum frequency component is equal to or greater than a predetermined value, the maximum frequency component is determined as the tonal component. That is, in the tonal component detection step S30, the tonal component, i.e. pure sound component, which is similar to the sine curve is detected in the frequency components of the original audio signal.

In the non-tonal component detection step S40, maximum frequency components other than the tonal components among the maximum frequency components are determined as the non-tonal components. That is, in the non-tonal component detection step, non-tonal component, i.e. noise component, similar to noise is detected from the frequency components of the original audio signal.

In other words, the tonal and non-tonal components correspond to the peak component of the original audio signal; the tonal component detection step S30 corresponds to a detection of the pure sound component with the sine curve characteristics from the peak components; and the non-tonal component detection step S40 corresponds to detection of the noise component, contrasted with the pure sound from the peak components.

In the irrelevant tonal and non-tonal component elimination step S50, tonal and non-tonal components which have the strength less than the absolute audibility threshold are eliminated from the tonal and non-tonal components. That is, in the irrelevant tonal and non-tonal component elimination step S50, the irrelevant and non-tonal inaudible components are eliminated only to determine the principal components.

In the individual frequency mask generation step S60, the individual frequency masks for each principal component (tonal and non-tonal) are calculated. The frequency mask is calculated by adding the strength of the principal components and the values of functions (for example, masking index and masking function) related to the predetermined mask used in the corresponding psychoacoustic model. Herein, the masking index is set differently depending on the tonal and non-tonal components, and the masking function is set to be the same for the tonal and non-tonal components. For example, the masking index may be given by a function, such as $a-b*z-c$ dB, of a bark frequency (or critical band rate) z for the principal components. The masking function may be given by a function of the strength X of the principal components and a bark distance dz (a distance between adjacent bark frequencies), such as $d*(dz+1)-(e*X+f)$ dB. Herein, the values of a to f are constant.

In the global mask generation step S70, the individual frequency masks are combined with the absolute audibility threshold to form a single global mask.

In the psychoacoustic mask generation step S80, a psychoacoustic mask corresponding to the difference between the global mask and the original audio signal is generated.

As described above, the steps should be performed over every consecutive signal segment, and the segment duration may be around 20-40 ms, which is a typical quasi-stationary duration of audio signals. Therefore, the duration of the FFT analysis window which is used to analyze residual signal spectrum and the duration of the multicarrier signal symbol can be set to be the same in order to deliver the best performance and simple implementation.

Further, the invention provides very flexible control between the distortions in the original audio signal and the communication data rate, which is determined by the cumulative signal-to-noise ratio in the acoustic communication signal. In practice, the distortions and data rate can be easily traded-off by adjusting the shape of attenuation filer. If the filter introduces less attenuation the original signal will be less distorted, the total signal-to-noise ratio in the acoustic communication signal will also be reduced. However, this will reduce the total data rate, and vice versa. Herein, 'signal' means the acoustic communication signal itself, and 'noise' means the original audio signal, since it is treated as a random noise by an acoustic communication receiver, assuming that the acoustic communication receiver does not have knowledge of the original audio signal.

The invention can be used in the acoustic communication systems for data transfer between mobile devices, such as mobile phones, portable multimedia devices, netbooks and so on. For example, the invention can be used jointly with the acoustic communication system for object transmission described in U.S. Publ. 2010-0290484 A1 entitled "Encoder, Decoder, Encoding Method, And Decoding Method" filed with the US Patent and Trademark Office on May 18, 2010 and assigned Ser. No. 12/782,520, the contents of each of which are incorporated herein by reference. The invention can be implemented in software using general purpose processors, or digital signal processor chips, or can be implemented in hardware or as a combination of both.

It can be seen that the embodiments of the invention are possible to be implemented by hardware, software, or the combination of both. For example, such software may be stored in a volatile or nonvolatile storage device such as ROM regardless of whether or not it can be erased or rewrote, or a memory such as RAM, memory chip, device or integrated circuit, or an optical or magnetic medium such as CD, DVD, magnetic disk or magnetic tape. It can be seen that the storage device and the storage medium are exemplarily implemented by a processor, which can be read by a machine suitable for storing a program which includes instructions for implementing the embodiments of the invention. Therefore, the embodiments provide a program including codes for implementing the system or method which is claimed in the invention, and a storage device which can be read by a machine which stored such program. Further, such program can be transferred electronically through any medium such as a communication signal which is transmitted through a wire or wireless connection, and the embodiments include the equivalence suitably.

While the invention has been shown and described with reference to certain embodiments thereof, it will be understood by those skilled in the art that various changes in form and details may be made therein without departing from the spirit and scope of the invention as defined by the appended claims.

What is claimed is:

1. An acoustic communication method comprising:

filtering, by a device, an audio signal to attenuate a high frequency section of the audio signal;

generating, by the device, a residual signal which corresponds to a difference between the audio signal and the filtered signal;

generating, by the device, a psychoacoustic spectrum mask for the audio signal based on a predetermined psychoacoustic model and the residual signal;

generating, by the device, an acoustic communication signal by modulating digital data according to the generated psychoacoustic spectrum mask; and combining, by the device, the acoustic communication signal with the filtered signal, radiating, by a speaker, the combined acoustic communication signal and the filtered signal in a form of sound waves.

2. The acoustic communication method of claim 1, wherein generating the psychoacoustic spectrum mask includes:

generating a psychoacoustic mask for the audio signal based on the predetermined psychoacoustic model; and generating the psychoacoustic spectrum mask by combining the residual signal with the psychoacoustic mask.

3. The acoustic communication method of claim 1, wherein filtering of the audio signal is performed by a frequency selection attenuation filter of the device which has a frequency response that reduces from a low frequency to a high frequency.

4. The acoustic communication method of claim 1, further comprising:

detecting a spectrum envelope of the residual signal.

5. The acoustic communication method of claim 4, wherein detecting of the spectrum envelope comprises:

performing a Fast Fourier Transform (FFT) on the residual signal; and estimating a spectrum envelope of the converted residual signal.

6. The acoustic communication method of claim 2, wherein generating the psychoacoustic mask comprises:

detecting peak components of the audio signal;

calculating individual frequency masks for the peak components; and generating a global mask by combining the individual frequency masks with an absolute audibility threshold, wherein the generating of the psychoacoustic mask corresponds to a difference between the global mask and the audio signal.

7. The acoustic communication method of claim 6, further comprising:

performing a Fast Fourier Transform (FFT) on the audio signal before detecting the peak components.

8. The acoustic communication method of claim 6, wherein detecting the peak components comprises:

detecting tonal and non-tonal components of the audio signal; and eliminating tonal and non-tonal components having strength less than an absolute audibility threshold among the tonal and non-tonal components.

9. The acoustic communication method of claim 1, wherein the acoustic communication signal is a multicarrier signal.

10. An acoustic communication device comprising:

a signal generator configured for:

filtering an audio signal to attenuate a high frequency section of the audio signal;

generating a residual signal which corresponds to a difference between the audio signal and the filtered signal;

generating a psychoacoustic spectrum mask for the audio signal based on a predetermined psychoacoustic model and the residual signal;

generating an acoustic communication signal by modulating digital data according to the psychoacoustic spectrum mask; and combining the acoustic communication signal with the filtered signal; and a speaker for radiating the combined acoustic communication signal and the filtered signal in a form of sound waves.

11. The acoustic communication device of claim 10, wherein the acoustic communication signal is a multicarrier signal.

12. The acoustic communication device of claim 10, wherein the signal generator is configured for:

generating a psychoacoustic mask for the audio signal based on the predetermined psychoacoustic model; and generating the psychoacoustic spectrum mask by combining the residual signal with the psychoacoustic mask.

13. The acoustic communication device of claim 10, further comprising a frequency selection attenuation filter which filters the audio signal to attenuate the high frequency section of the audio signal, and has a frequency response that reduces from a low frequency to a high frequency.

14. The acoustic communication device of claim 10, wherein the signal generator detects a spectrum envelope of the residual signal.

15. The acoustic communication device of claim 14, wherein the signal generator performs Fast Fourier Transform (FFT) on the residual signal and estimates a spectrum envelope of the converted residual signal.

16. The acoustic communication device of claim 12, wherein the signal generator detects peak components of the audio signal, calculates individual frequency masks for the peak components, and generates a global mask by combining the individual frequency masks with an absolute audibility threshold, and wherein the psychoacoustic mask corresponds to a difference between the global mask and the audio signal.

17. The acoustic communication device of claim 16, wherein the signal generator performs a Fast Fourier Transform (FFT) on the audio signal before detecting the peak components.

18. The acoustic communication device of claim 16, wherein the signal generator detects tonal and non-tonal components of the audio signal, and eliminates tonal and non-tonal components having strength less than an absolute audibility threshold among the tonal and non-tonal components.

* * * * *

UNITED STATES PATENT AND TRADEMARK OFFICE

CERTIFICATE OF CORRECTION

PATENT NO. : 9,251,807 B2
APPLICATION NO. : 14/011466
DATED : February 2, 2016
INVENTOR(S) : Jung et al.

It is certified that error appears in the above-identified patent and that said Letters Patent is hereby corrected as shown below:

On The Title Page,

Item (30) Foreign Application Priority Data

"November 25, 2011" should be -- November 25, 2010 --.

Signed and Sealed this
Thirty-first Day of May, 2016

Michelle K. Lee

Michelle K. Lee
*Director of the United States Patent and Trademark Office*